US008025491B2

(12) United States Patent
Wang

(10) Patent No.: US 8,025,491 B2
(45) Date of Patent: Sep. 27, 2011

(54) AIR PUMP HAVING SELECTABLE LOW PRESSURE AND HIGH PRESSURE MODE

(76) Inventor: Lopin Wang, Taichung (TW)

( * ) Notice: Subject to any disclaimer, the term of this patent is extended or adjusted under 35 U.S.C. 154(b) by 997 days.

(21) Appl. No.: 11/875,517

(22) Filed: Oct. 19, 2007

(65) Prior Publication Data

US 2009/0104059 A1 Apr. 23, 2009

(51) Int. Cl.
*F04B 39/10* (2006.01)

(52) U.S. Cl. ..... 417/468; 417/252; 417/460; 417/547

(58) Field of Classification Search ..... 417/252, 417/460, 468, 469, 527, 528, 547
See application file for complete search history.

(56) References Cited

U.S. PATENT DOCUMENTS 799,786 A * 9/1905 Freel ..... 417/466
4,278,114 A * 7/1981 Ruberg ..... 141/65
5,165,876 A 11/1992 Wang
5,353,870 A * 10/1994 Harris ..... 166/68
5,443,370 A 8/1995 Wang
5,676,529 A * 10/1997 Hermansen et al. ..... 417/259
5,779,457 A * 7/1998 Chuang et al. ..... 417/467
6,027,319 A * 2/2000 Winefordner et al. ..... 417/440
6,325,601 B2 * 12/2001 Wu ..... 417/469
6,428,290 B1 * 8/2002 Wang ..... 417/468
6,702,556 B2 * 3/2004 Axelsson ..... 417/523
7,353,746 B2 * 4/2008 Kutella ..... 92/61
2002/0085921 A1 * 7/2002 Gram et al. ..... 417/53

* cited by examiner

*Primary Examiner* — Charles Freay
*Assistant Examiner* — Patrick Hamo
(74) *Attorney, Agent, or Firm* — Browdy and Neimark, PLLC

(57) ABSTRACT

An air pump, including: two cylinders, a big one and a small one, which are telescopically fitted to each other. A head connects with the outlet end of the small cylinder. A pressure relief valve connects with the outlet end of the big cylinder. A first piston is fixed at the inlet end of the small cylinder and placed in the big cylinder. A first pipe, has one end fixed on the outlet end of the big cylinder, and the other passes through the first piston and placed inside the small cylinder. A first chamber with a passage communicating with the first pipe forms therein between the inside wall of the big cylinder and the outside wall of the first pipe. A second pipe, one end fixed at the outlet end of the small cylinder and communicating with the head in one-way air admission, has the other fit into the first pipe in a telescopicing way and communicating with it. A second piston, which is placed inside the small cylinder, fixes at the other end of the first pipe and the second pipe goes through it. A second chamber with a one-way passage communicates with the head and is formed therein between the inside wall of the small cylinder and the outside wall of the second pipe and between the outlet end of the small cylinder and the second piston.

2 Claims, 3 Drawing Sheets

AIR PUMP HAVING SELECTABLE LOW PRESSURE AND HIGH PRESSURE MODE

BACKGROUND OF THE INVENTION

1. Field of the Invention

The present invention relates to an air pump and more particular to an air pump having selectable low pressure and high pressure mode.

2. Description of the Related Art

In the prior art, U.S. Pat. No. 5,165,876 discloses a telescope air pump with two cylindrical bodies. One cylindrical body is fitted to one end of the other cylindrical body. There is a piston rod and a two-way air admission piston provided therein. So, the air pump can be divided into three air chambers. The air pump inflates an object when it is pushed or pulled.

U.S. Pat. No. 5,443,370 discloses a telescope air pump with three divisible cylinders. By increasing the route of push and pull, the air pump increases the air quantity in every stroke motion. The two adjacent cylinders can be locked together to make the big cylinder invalid and only two small cylinders keep working in high pressure mode.

U.S. Pat. No. 5,676,529 discloses a telescope air pump with two cylinders. There is an air passage provided between the big cylinder and the small cylinder. The air flows from the big cylinder to the small cylinder then goes into the head.

U.S. Pat. No. 6,027,319 discloses a telescope air pump with two cylinders. In this case, the big cylinder and the small cylinder inflate an object individually.

In order to operate in high pressure mode, patent 529 provides a knob as a pressure relief valve. The big cylinder at rear end will lose efficacy by turning the knob. Patent 319 provides a big cylinder at front and connects with the head at the front end. A pressure relief valve is provided at front and the big cylinder will lose efficacy by opening the valve also. But, there is a disadvantage of reorganization if the pressure relief valve operates by the way of rotation. In patent 529, when doing the inflation, the air in the big cylinder is pressed into the small cylinder first then goes inside the head. However, we will have P2>P1>P if the air pressure in the head is P, the air pressure in the small cylinder is P1 and the air pressure in the big cylinder is P2.

We will have P2=P1>P if we have the same assumption P, P1, P2 in patent 319. In according with the big cylinder and the small cylinder inflate an object individually; the air can inflate an object only when the air pressure is large then the air pressure in the head. If the air pressure in the big cylinder and the small cylinder is different, the low pressure part stops inflating an object for increasing air pressure and the high pressure part inflates an object first for releasing air pressure. The big cylinder and the small cylinder inflate an object at the same time when the air pressure is equal in both.

As the same reason as aforesaid, under the same operation power, patent 529 is easier to feel the resistance and needs to turn into the high pressure mode. Contrary to patent 319, in according to the two independent cylinders design, patent 319 provides a longer operation period in low pressure mode and the inflation efficiency is better then patent 529.

But the big cylinder in patent 319 is provided at front and connects with the head. This is more inconveniently then patent 529 to put the big cylinder into the very dense steel wires of the steel rim because that the small cylinder in patent 529 is provided at front.

SUMMARY OF THE INVENTION

The primary object of the present invention is to provide an air pump having selectable low pressure and high pressure mode and also has better inflation efficiency and convenience operation.

The second object of the present invention is to provide an air pump having selectable low pressure and high pressure mode and the selected mode is easy to recognize.

To achieve objects of the present invention, the air pump including: two cylinders, a big one and a small one, is fitted to each other by a contractible way. A head connects with the out end of the small cylinder. A pressure relief valve connects with the out end of the big cylinder. A first piston is fixed at the in end of the small cylinder and placed in the big cylinder. A first pipe, one end fixes on the out end of the big cylinder, and the other passes through the first piston and places inside the small cylinder. A first chamber with a passage communicating with the first pipe forms therein between the inside wall of the big cylinder and the outside wall of the first pipe. A second pipe, one end fixes at the out end of the small cylinder and communicates with the head in one-way air admission and the other fits into the first pipe and communicates with it. A second piston, which is placed inside the small cylinder, fixes at the other end of the first pipe and the second pipe goes through it. A second chamber with a one-way passage communicating with the head forms therein between the inside wall of the small cylinder and the outside wall of the second pipe.

DETAILED DESCRIPTION OF THE INVENTION

Figure 1:
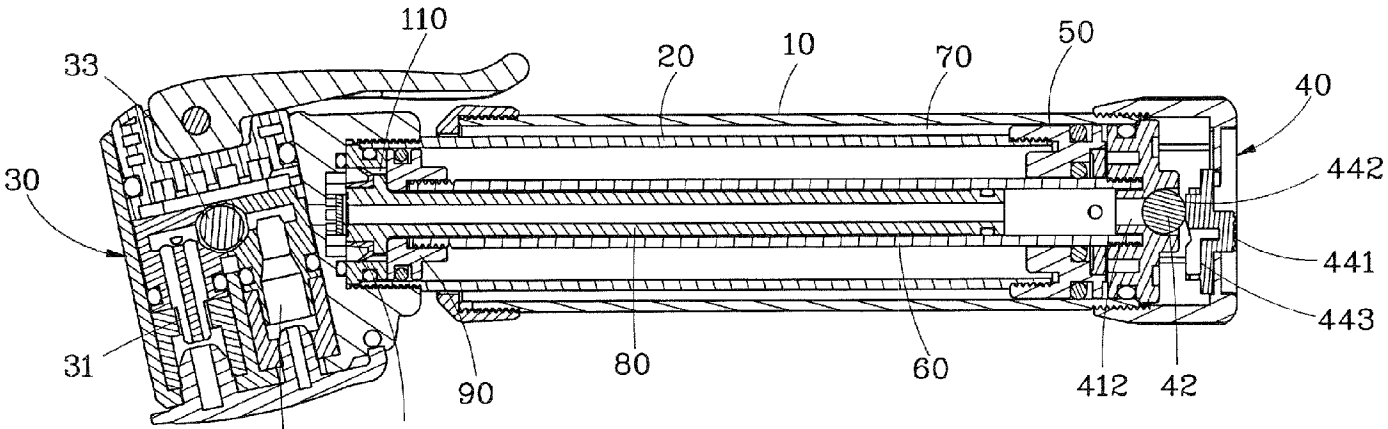
FIG. 1 is a sectional view of present invention showing the short status.
Figure 2:
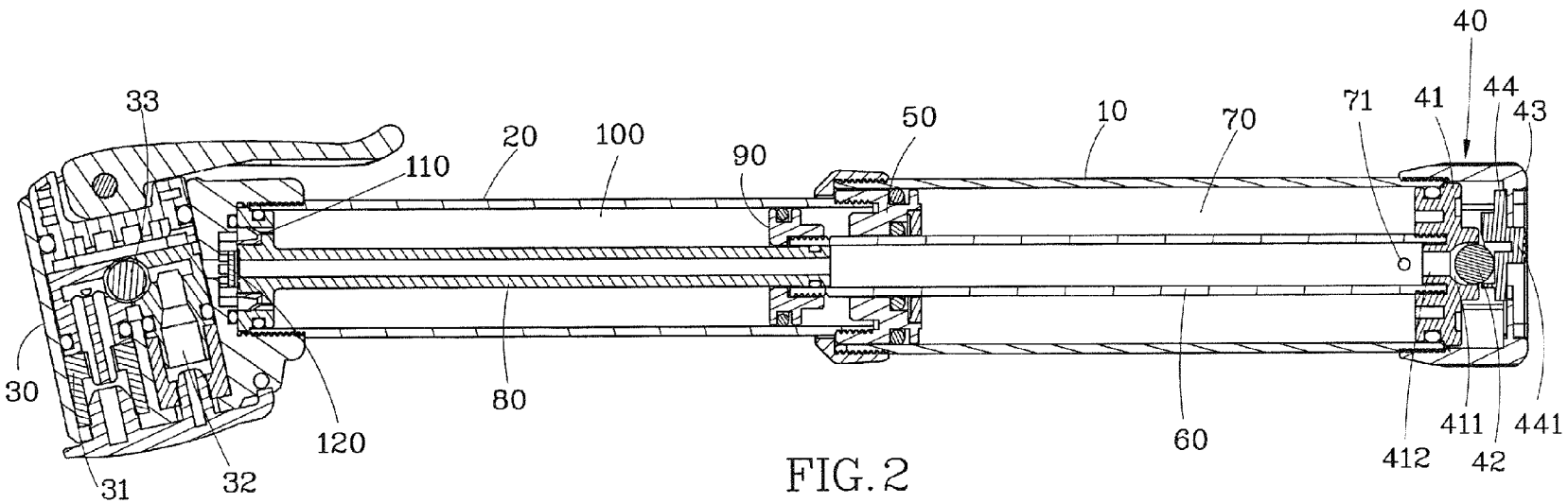
FIG. 2 is a sectional view of present invention showing the expanding status.
Figure 3:
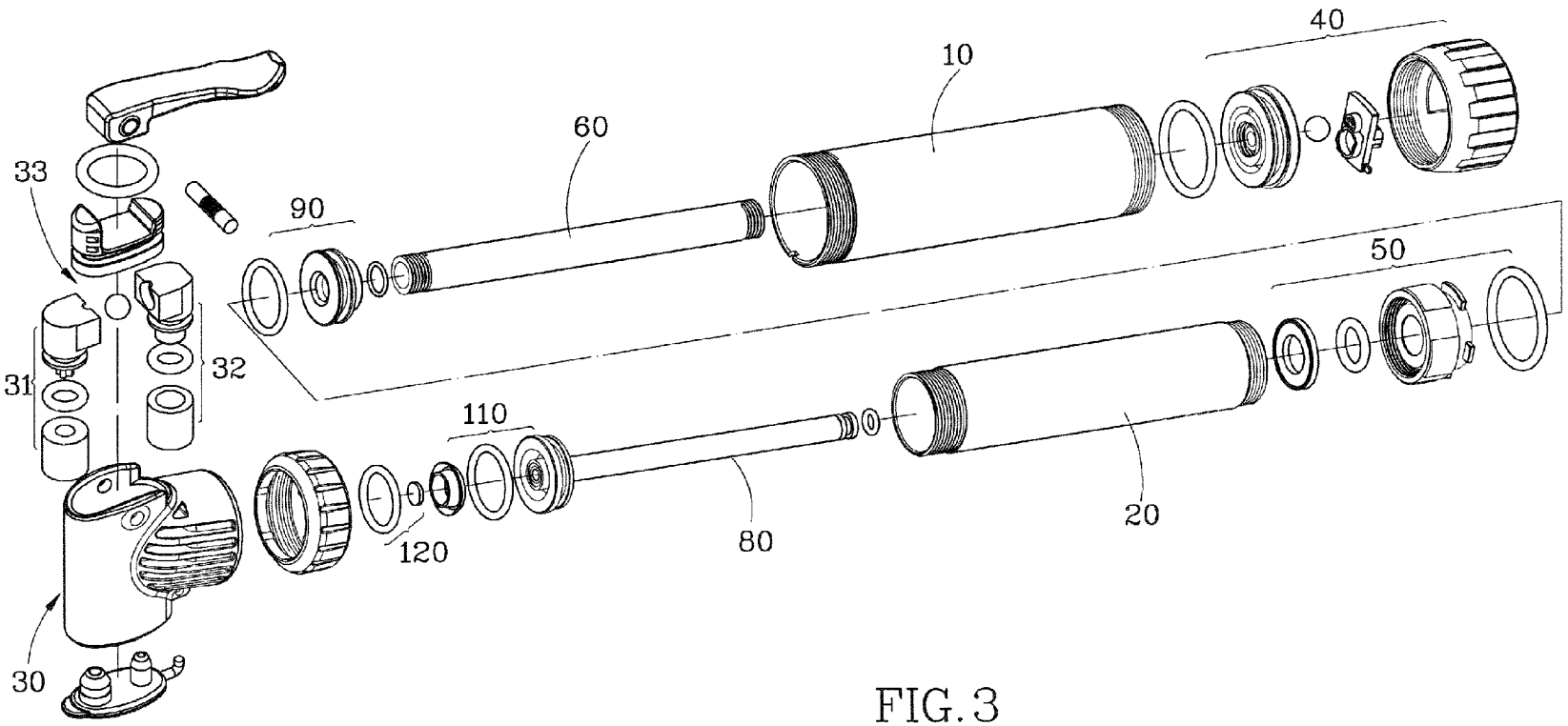
FIG. 3 is a perspectively exploded view of the present invention.

Referring to FIG. 1, FIG. 2 and FIG. 3, the air pump of present invention, including:

A big cylinder 10 and a small cylinder 20 expandable are fitted to each other.

A head 30 connects with the out end of said small cylinder 20.

A pressure relief valve 40 connects with the out end of said big cylinder 10.

A first piston 50 fixes at the in end of said small cylinder and is placed inside said big cylinder 10.

A first pipe 60, one end fixes on the out end of said big cylinder 10 and places inside said big cylinder 10, and the other passes through said first piston 50 and places inside said small cylinder 20.

A first chamber 70 with a passage 71 communicating with said first pipe 60 forms therein between the inside wall of said big cylinder 10 and the outside wall of said first pipe 60 and between the out end of said big cylinder 10 and said first piston 50. Said passage 71 is a hole that is provided on said first pipe 60 near to the out end in this embodiment.

A second pipe 80, one end fixes at the out end of said small cylinder 20 and communicates with said head in one-way air admission and the other fits into said first pipe and communicates with it. By the way, said first chamber 70 has a one-way communication with said head 30.

A second piston 90, which is placed inside said small cylinder 20, fixes at the other end of said first pipe 70 and said second pipe 80 goes through it.

A second chamber 100 with a one-way passage 110 communicating with said head 30 forms therein between the inside wall of said small cylinder 20 and the outside wall of said second pipe 80 and between the out end of said small cylinder 20 and said second piston 90.

Figure 4:
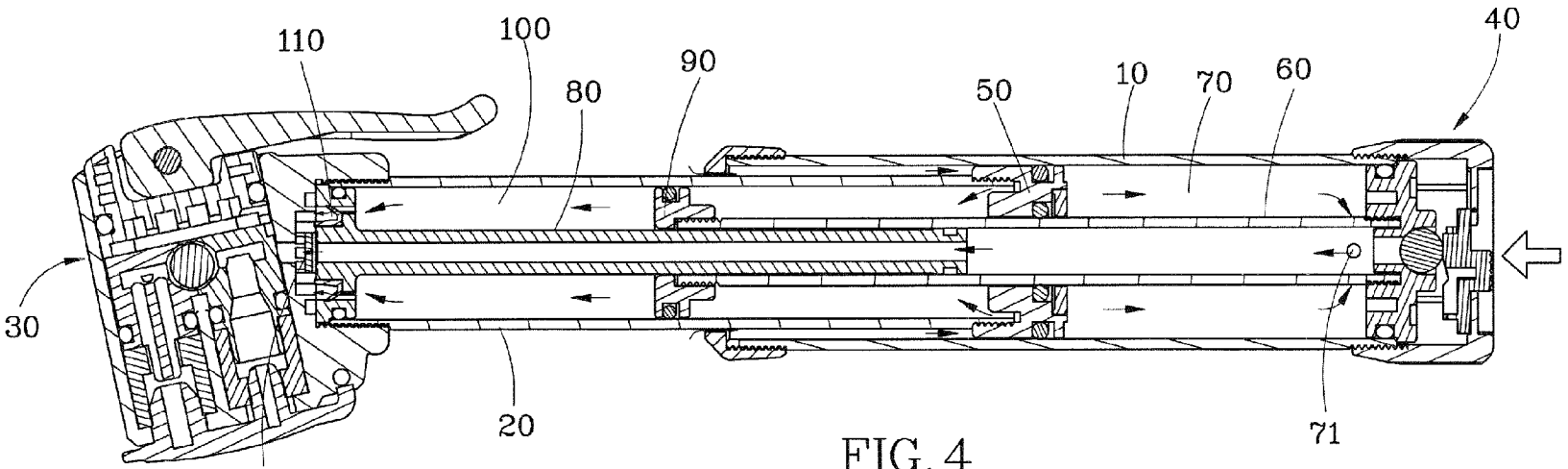
FIG. 4 is a diagram of present invention showing the airflow of compression status.
Figure 5:
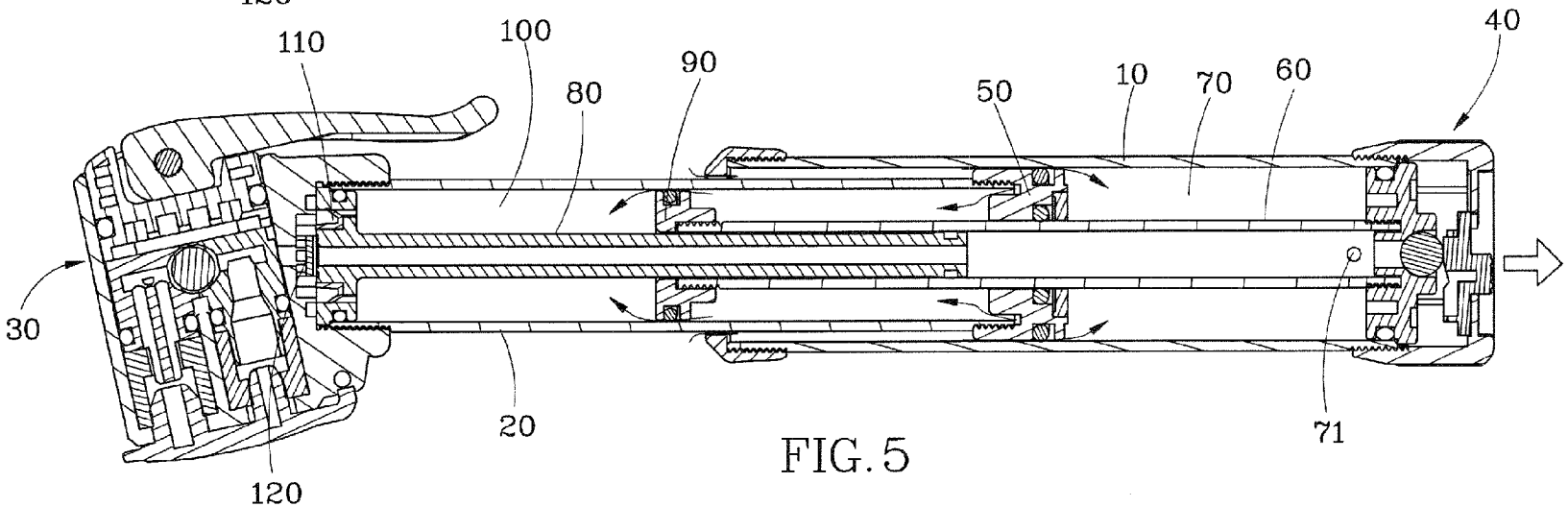
FIG. 5 is a diagram like FIG. 4 showing the airflow of expanding status.

Referring to FIG. 4 and FIG. 5, these are diagrams showing the direction of airflow in operation.

As shown in FIG. 4, when said big cylinder 10 is pushed toward said small cylinder 20, the air in said first chamber 70 will be compressed to pass through said passage 71 and into said first pipe 60 then goes into said head 30 by said second pipe 80. The air in said second chamber 100 will be compressed also to pass through said one-way passage 110 and into said head.

As shown in FIG. 5, when said big cylinder 10 is pulled away from said small cylinder 20, the air in said head 30 cannot return and is blocked by said one-way passage 110 and another one-way valve 120. The outside air can go through said first piston 50 and said second piston 90 then goes into said first chamber 70 and said second chamber 100.

When the pressure reaches a certain quantity, opening said pressure relief valve 40 could make the connection of said first chamber 70 and outside become invalid as shown in FIG. 2 then, only said second chamber 100 that has smaller section is workable. So, the operator can save power and inflates an object to a higher pressure easily.

The structures of the pressure relief valve are described hereinafter.

The pressure relief valve 40 including:

A valve seat 41 is placed at the out end of said big cylinder 10 and connected with said first pipe 60. There is a pit 411 with a curve bottom provided on said valve seat 40. There is a bore 412 provided at the bottom center of said pit and communicates with said first pipe 60.

A sealed member 42 places in said pit 411 for sealing said bore 412.

A cover 43 is mounted at said big cylinder 10 and covers said valve seat 41.

A switch 44 with a switching end 441 that bulges out of said cover 43 is placed between said valve seat 41 and said cover 43 and able to switch between an open position and a close position. Said switch 44 has an extrusive portion 442 and an intrusive portion 443 corresponding to the face of said valve seat 41. When said switch 44 is in the close position, said extrusive portion 442 faces to the pit 411 of said valve seat 41 and pushes said sealed member 42 forward to said pit 411 and seals said bore 412. When said switch 44 is in the open position, said intrusive portion 443 faces to the pit 411 of said valve seat 41 and provides a space for said sealed member 42 to move. So, the bore 412 of said pit 411 is no longer sealed.

The head 30 has a schrader valve 31 and a presta valve 32 in this embodiment. An Auto changing valve 33 is provided therein and connects with those two valves 31 32. By the way, the head can change the function of the valve automatically. The detail description can be found in U.S. Pat. No. 5,960,815.

Furthermore, said second pipe 80 of present invention has a function as a piston also. When said second pipe 80 is pushed into said first pipe 60, it compresses the air inside said first pipe 60 and makes the air inject into the head 30 quickly. This action has an effect of increasing quick air inflation. To compare with U.S. Pat. No. 5,676,592, the first pipe 60 of present invention is equal to the inner cylindrical tube 24 of the patent '529. But, the inner cylindrical tube 24 of the patent '529 is only a passage, and has no compression function.

What is claimed is:

1. An air pump having selectable low pressure and high pressure modes, including:

a big cylinder and a small cylinder being fitted to each other to define a telescopic cylinder;

a head connected with one end of said telescopic cylinder;

two pistons being placed in said big and small cylinders and dividing said cylinders into a big and a small chamber;

a pressure relief valve being placed in said big cylinder and connected with said big chamber:

a valve seat being placed at an outer end of said big cylinder and connected with a first pipe, there being a pit with a curved bottom provided on said valve seat; there being a bore provided at the bottom of said pit and communicating with the inside of said big cylinder;

a sealed member placed in said pit for sealing said bore;

a cover being mounted at said big cylinder and covering said valve seat;

a switch with a switching end that bulges out of said cover being placed between said valve seat and said cover and able to switch between an open position and a closed position, said switch having an extrusive portion and an intrusive portion corresponding to the face of said valve seat;

when said switch being in the closed position, said extrusive portion facing to the pit of said valve seat and pushing said sealed member forward to said pit and sealing said bore, when said switch being in the open position, said intrusive portion facing to the pit of said valve seat and providing a space for said sealed member to move, so, the bore of said pit being not sealed.

2. An air pump having selectable low pressure and high pressure modes, including:

two cylinders, a big one and a small one, being contrastably connected to each other;

a head connected with an outlet end of said small cylinder;

a pressure relief valve connected with the outlet end of said big cylinder;

a first piston fixed at the inlet end of said small cylinder and being placed inside said big cylinder;

a first pipe, one end fixed on an outer end of said big cylinder and placed inside said big cylinder, and the other passing through said first piston and placed inside said small cylinder;

a first chamber with a passage communicating with said first pipe formed therein between the inside wall of said big cylinder and the outside wall of said first pipe and between the outlet end of said big cylinder and said first piston;

a second pipe, one end fixing at the outlet end of said small cylinder and communicating with said head and the other fitting into said first pipe and communicating with it;

a second piston, which is placed inside said small cylinder, fixed at the other end of said first pipe and said second pipe passing therethrough;

a second chamber with a one-way passage communicating with said head formed therein between the inside wall of said small cylinder and the outside wall of said second pipe and between the outer end of said small cylinder and said second piston;

a valve seat being placed at the outlet end of said big cylinder and connecting with said first pipe, there being a pit with a curved bottom provided on said valve seat;

there being a bore provided at the bottom of said pit and communicating with the inside of said big cylinder;

a sealed member placed in said pit for sealing said bore;

a cover being mounted at said big cylinder and covering said valve seat;

a switch with a switching end that bulges out of said cover being placed between said valve seat and said cover and able to switch between an open position and a closed position, said switch having an extrusive portion and an intrusive portion corresponding to the face of said valve seat;

when said switch being in the closed position, said extrusive portion facing to the pit of said valve seat and pushing said sealed member forward to said pit and sealing said bore, when said switch being in the open position, said intrusive portion facing to the pit of said valve seat and providing a space for said sealed member to move, so, the bore of said pit being not sealed.

* * * * *